US011666832B2

(12) United States Patent
Knijpstra

(10) Patent No.: US 11,666,832 B2
(45) Date of Patent: Jun. 6, 2023

(54) SUPPORT CONSTRUCTION FOR A TRANSPORTABLE ATTRACTION FOR AMUSEMENT RIDES AND METHOD FOR RAISING THE SUPPORT CONSTRUCTION

(71) Applicant: K.I.G. Heerenveen B.V., Terband-Heerenveen (NL)

(72) Inventor: Hette Knijpstra, Terband-Heerenveen (NL)

(73) Assignee: K.I.G. Heerenveen B.V., Terband-Heerenveen (NL)

( * ) Notice: Subject to any disclaimer, the term of this patent is extended or adjusted under 35 U.S.C. 154(b) by 0 days.

(21) Appl. No.: 17/447,798

(22) Filed: Sep. 15, 2021

(65) Prior Publication Data

US 2022/0080326 A1 Mar. 17, 2022

(30) Foreign Application Priority Data

Sep. 16, 2020 (NL) ..... 2026482

(51) Int. Cl.
*A63G 27/00* (2006.01)
*A63G 27/02* (2006.01)

(52) U.S. Cl.
CPC ..... *A63G 27/00* (2013.01); *A63G 2200/00* (2013.01)

(58) Field of Classification Search
CPC ..... A63G 27/00; A63G 27/02; A63G 27/04; A63G 27/06; A63G 27/08
USPC ..... 472/30–33, 3
See application file for complete search history.

(56) References Cited

U.S. PATENT DOCUMENTS 3,456,943 A 7/1969 Brown
3,552,747 A * 1/1971 Deem ..... A63G 27/00 472/3
2003/0162596 A1* 8/2003 Kroon ..... A63G 27/00 472/30
2004/0198523 A1* 10/2004 Kroon ..... A63G 27/00 473/32
2006/0079338 A1* 4/2006 Kroon ..... A63G 27/00 472/29

FOREIGN PATENT DOCUMENTS

DE 202020103420 U1 6/2020
EP 2055362 A1 5/2009

* cited by examiner

*Primary Examiner* — Kien T Nguyen
(74) *Attorney, Agent, or Firm* — Oppedahl Patent Law Firm LLC

(57) ABSTRACT

A support construction for a transportable attraction for amusement rides is provided with a base, at least two masts that are moveable between a folded and stretched position, and a main shaft that is intended to be supported by the masts in the stretched position of the masts. Each mast comprises a base mast segment, which is hingedly attached to the base, and a top mast segment, which is hingedly connected with the base mast segment and is attachable to the main shaft. The base comprises at least two trailers and trailer coupling means for coupling the trailers. On each of the trailers a base mast segment of one of the masts is mounted. The support construction further comprises first mast coupling means for the coupling of a first pair of masts in folded position. A method for raising the support construction is set forth.

10 Claims, 11 Drawing Sheets

2

SUPPORT CONSTRUCTION FOR A TRANSPORTABLE ATTRACTION FOR AMUSEMENT RIDES AND METHOD FOR RAISING THE SUPPORT CONSTRUCTION

The present invention refers to a support construction for a transportable attraction for amusement rides, such as a fairground attraction, provided with a base, at least two masts that are moveable between a folded and stretched position, and a main shaft that is intended to be supported by the masts in the stretched position of the masts, wherein a rotatable part of the attraction can be mounted on the main shaft, wherein each mast comprises a base mast segment, which is hingedly attached to the base, and a top mast segment, which is hingedly connected with the base mast segment and is attachable to the main shaft.

Such a support construction is described in the Dutch patent NL1034591 of the same applicant. The known support construction comprises a base in the shape of a trailer with thereon a first mast with three hingedly interconnected segments and a second mast with two hingedly interconnected segments. The two masts are permanently connected at the location of the top mast segments. Two of the known mobile support constructions are needed to support a Ferris wheel.

The known support construction has as an advantage that a relatively big fairground attraction can be constructed in a quick and safe manner from a relatively compact base.

In the relevant art, there has been a trend for several years to develop bigger and bigger mobile attractions. The disadvantage of the known support construction is that the required length of the trailers for such large mobile attractions, such as a Ferris wheel, has become so big that requirements are imposed on road transport in various European countries. Depending on the locally applicable rules, this may mean that the road transport is subject to a permit and/or can only take place via diversions and/or only at night.

The present invention has for its object to provide a support construction according to the preamble that solves this disadvantage.

The support construction according to the present invention has to that end the characteristic, that the base comprises at least two trailers and trailer coupling means for coupling the trailers, wherein on each of the trailers a base mast segment of one of the masts is mounted, wherein the support construction further comprises first mast coupling means for the coupling of a first pair of masts in folded position.

The support construction according to the invention has to its advantage that each trailer transports but one mast in the folded position causing masts of equal or greater length to be transported with smaller (permit-free) trailers in comparison to the masts and trailers of the known support construction. The masts can be coupled pairwise on site, preferably in the folded position, such that the use of a high crane can be avoided.

It is noted that DE202020103420 describes a support construction according to the preamble of claim 1, wherein the masts have to be coupled in the stretched position.

In a first preferred embodiment the support construction comprises four masts and the base comprises four trailers, wherein on each of the four trailers a base mast segment of one of the four masts is mounted, wherein the support construction further comprises second mast coupling means for the coupling of a second pair of masts in folded position.

In the first preferred embodiment, the support construction according to the invention is suitable for supporting a Ferris wheel.

In an elegant, preferred embodiment, the main shaft is provided at one end with the first mast coupling means. The first mast coupling means are arranged to be coupled with a top mast segment of a first mast. This measure allows for the main shaft to be connected with a top mast segment of a first mast through the first mast coupling means. This can by choice take place prior to the transport or on site when the first mast is still in folded position. The first mast coupling means are arranged to be coupled with a top mast segment of a second mast. This can take place on site when the first and second mast are still in folded position. In but one step the first and second mast are then coupled pairwise with each other and simultaneously are connected to the main shaft. The use of a high crane is not necessary for this.

According to a further elaboration of the elegant, preferred embodiment, the main shaft is provided at the opposite end with connecting means for connecting the second mast coupling means. The second mast coupling means are arranged to be coupled with a top mast segment of a third mast. This can by choice take place prior to the transport or on site, when the third mast is still in folded position. The second mast coupling means are arranged to be coupled to a top mast segment of a fourth mast. This can take place on site when the third and fourth mast are still in folded position. When the first and second mast are jointly (almost) in the stretched position and when the third and fourth mast are also jointly (almost) in the stretched position, the connecting means can be connected with the second mast coupling means.

In an optimal preferred embodiment every mast comprises a middle mast segment, which is hingedly connected to the base mast segment and the top mast segment. With masts consisting of three hinged segments, a mast with greater length can be transported, that is suitable for forming a support construction for a Ferris wheel with a larger diameter and that is transportable in folded position on a relatively small (permit-free) trailer.

According to a very safe preferred embodiment, the middle mast segment and the top mast segment are connected by a first power hinge and the middle mast segment is provided with first operating means for operating the first power hinge. The top mast segment can herewith be stretched automatically relative to the middle mast segment.

According to a further very safe preferred embodiment, the middle mast segment and the base mast segment are connected with a second hinge, which opens and closes by operating the second operating means, which extend from the respective trailer to the base mast segment. The middle mast segment and the base mast segment can herewith be automatically stretched. Moreover, the whole mast can herewith be moved relative to the base. Together with the first operating means, the second operating means can be used to align each pair of coupled masts relative to each other for connecting the main shaft.

In a practical preferred embodiment, each trailer has a longitudinal direction and the mast segments of the mast attached to the trailer extend pivotably from the plane that extends perpendicularly on the trailer in the longitudinal direction. The pivotable position is of advantage when aligning the mast pairs for connecting the main shaft.

The present invention also relates to a method for raising the support constructions according to the first preferred embodiment with four masts and four trailers, whereby the method comprises the following steps:

a) the positioning of the trailers;
b) the coupling of the trailers with the trailer coupling means;
c) the pairwise coupling of the first and second mast with the first mast coupling means and the main shaft;
d) the pairwise coupling of the third and fourth mast with the second mast coupling means;
e) the joint raising of the first and second mast;
f) the joint raising of the third and fourth mast;
g) the optional alignment of the main shaft relative to the second mast coupling means by the hinging of one or more of the base mast segments; and
h) the connecting of the main shaft with the second mast coupling means.

The invention will now be described in more detail with reference to the figures.

Figure 1:
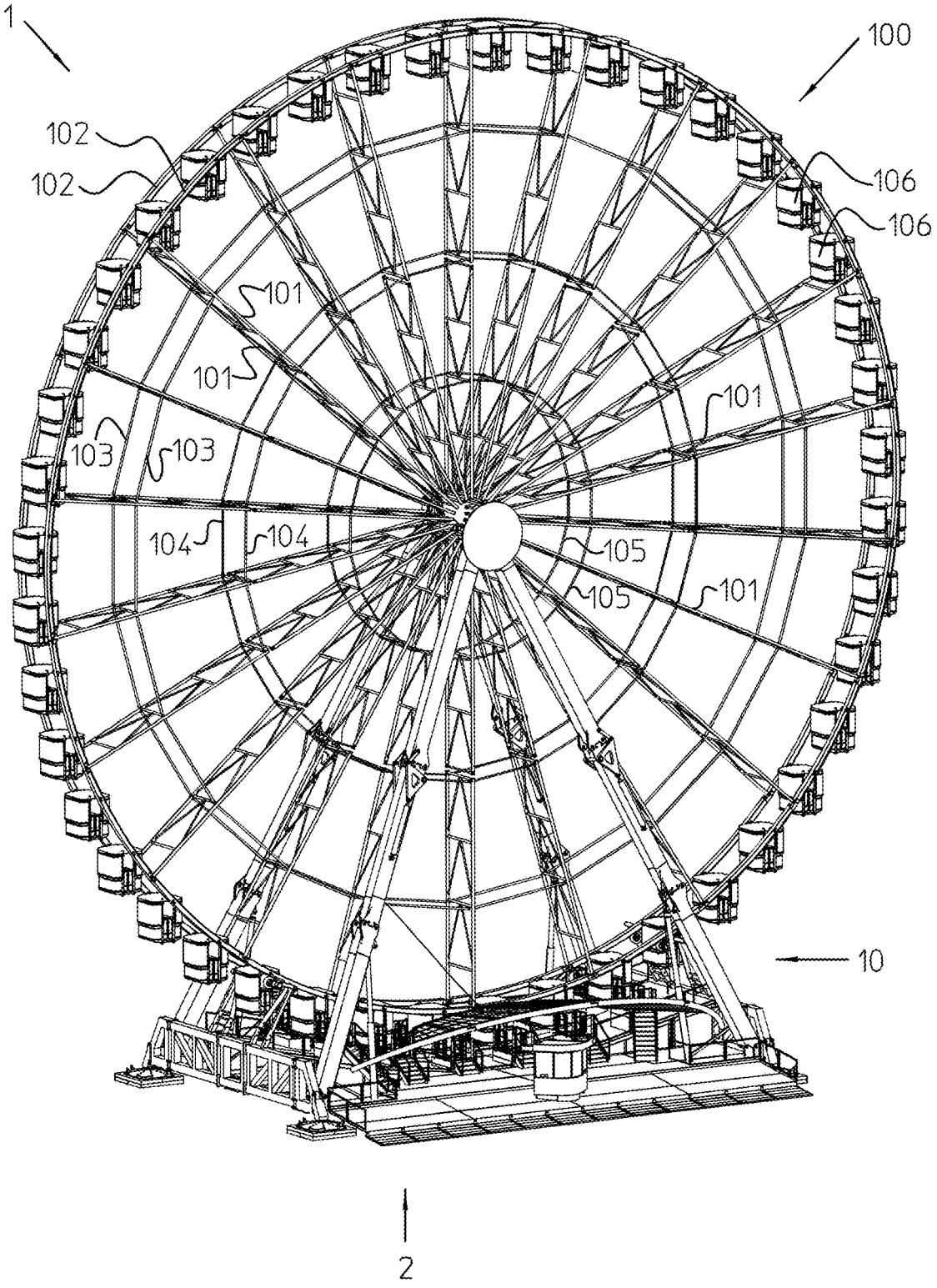
FIG. 1 shows a schematic view of an attraction mounted on a support construction according to the invention in a position of use.
Figure 3:
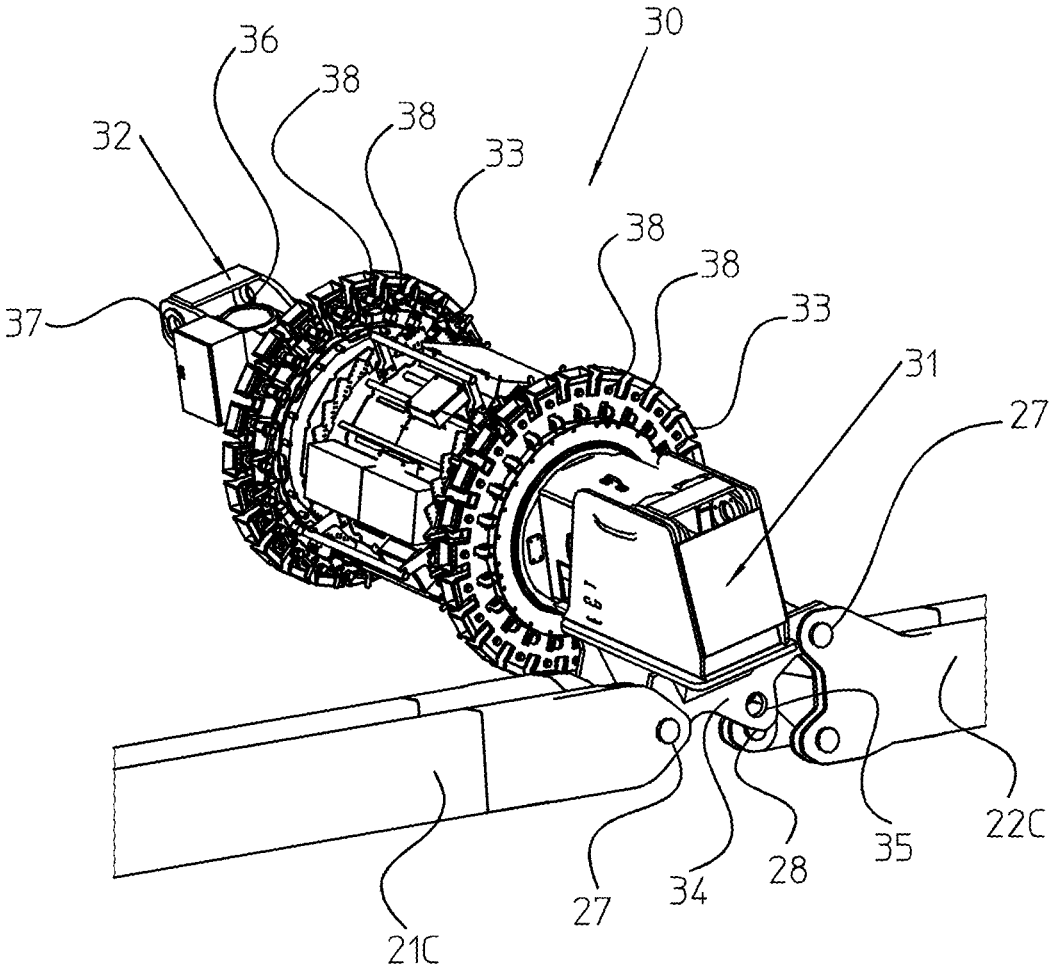
Figure 4:
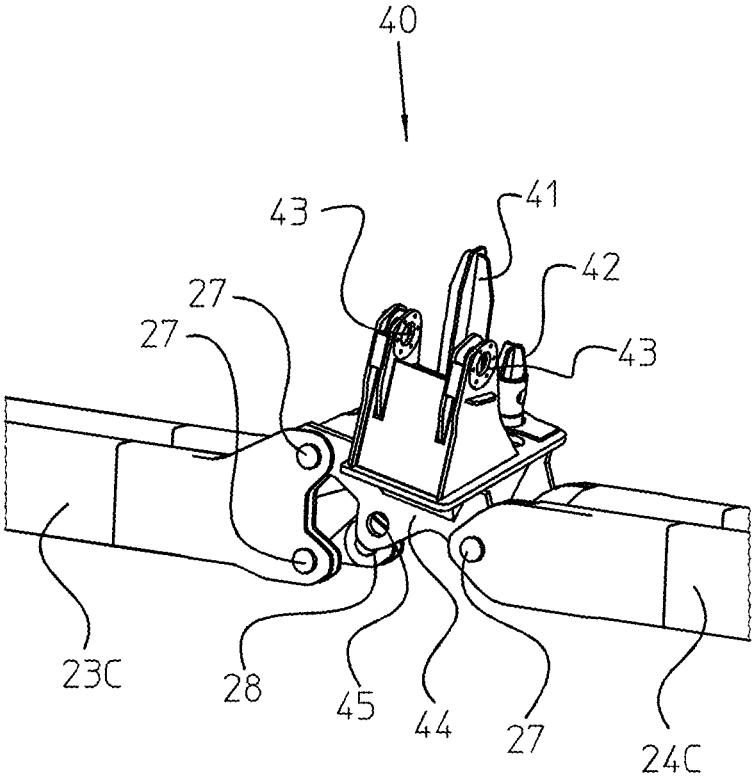
Figure 5A:
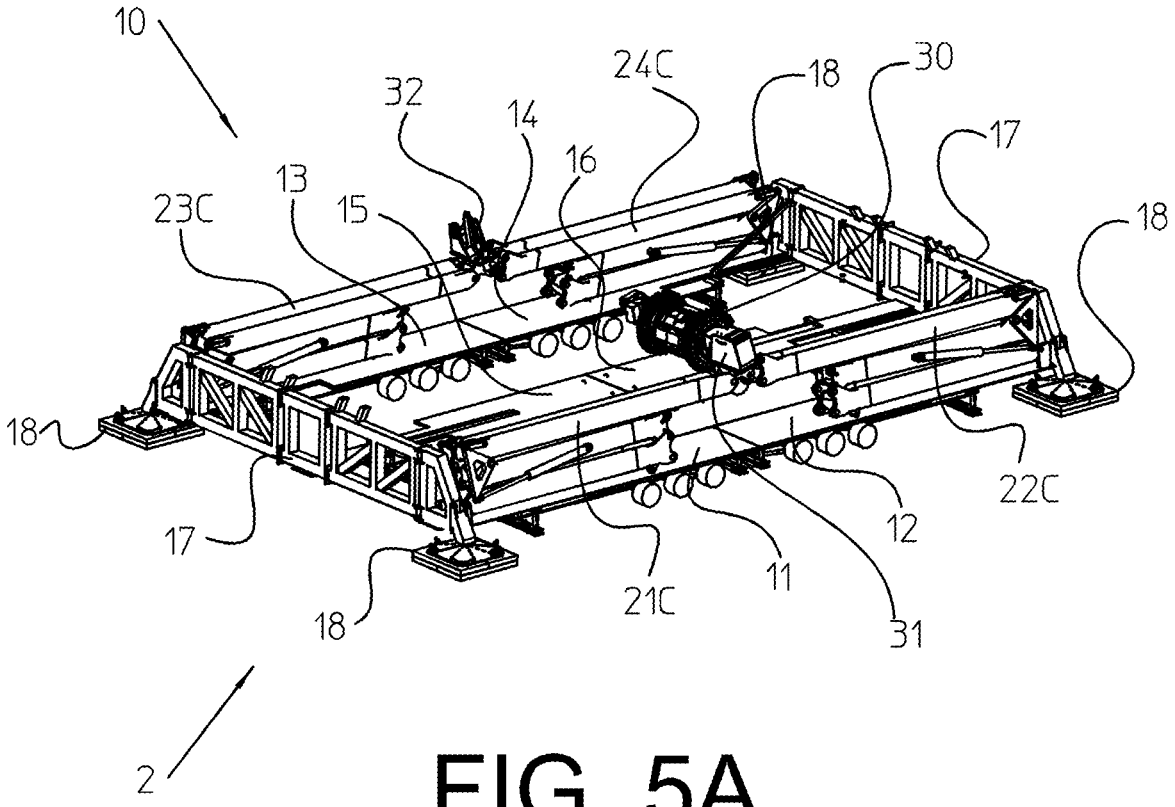
Figure 5B:
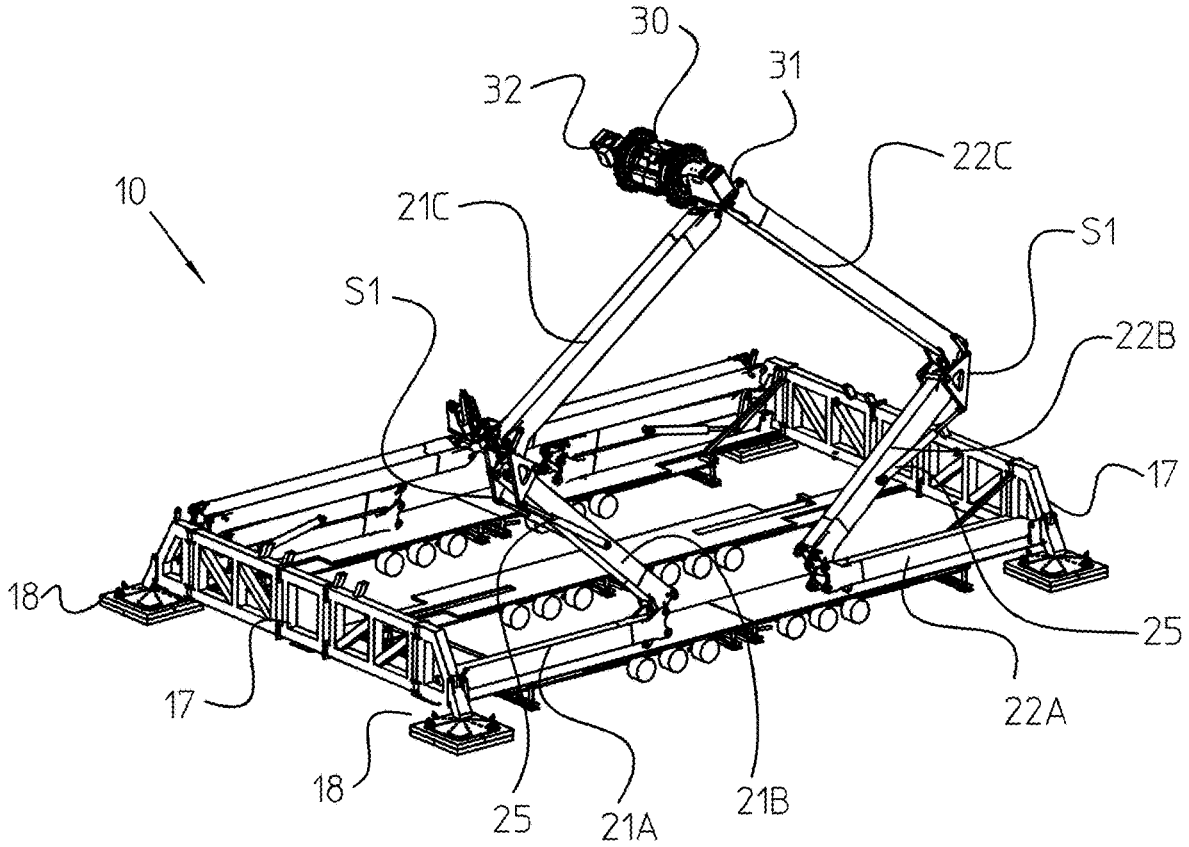
Figure 5C:
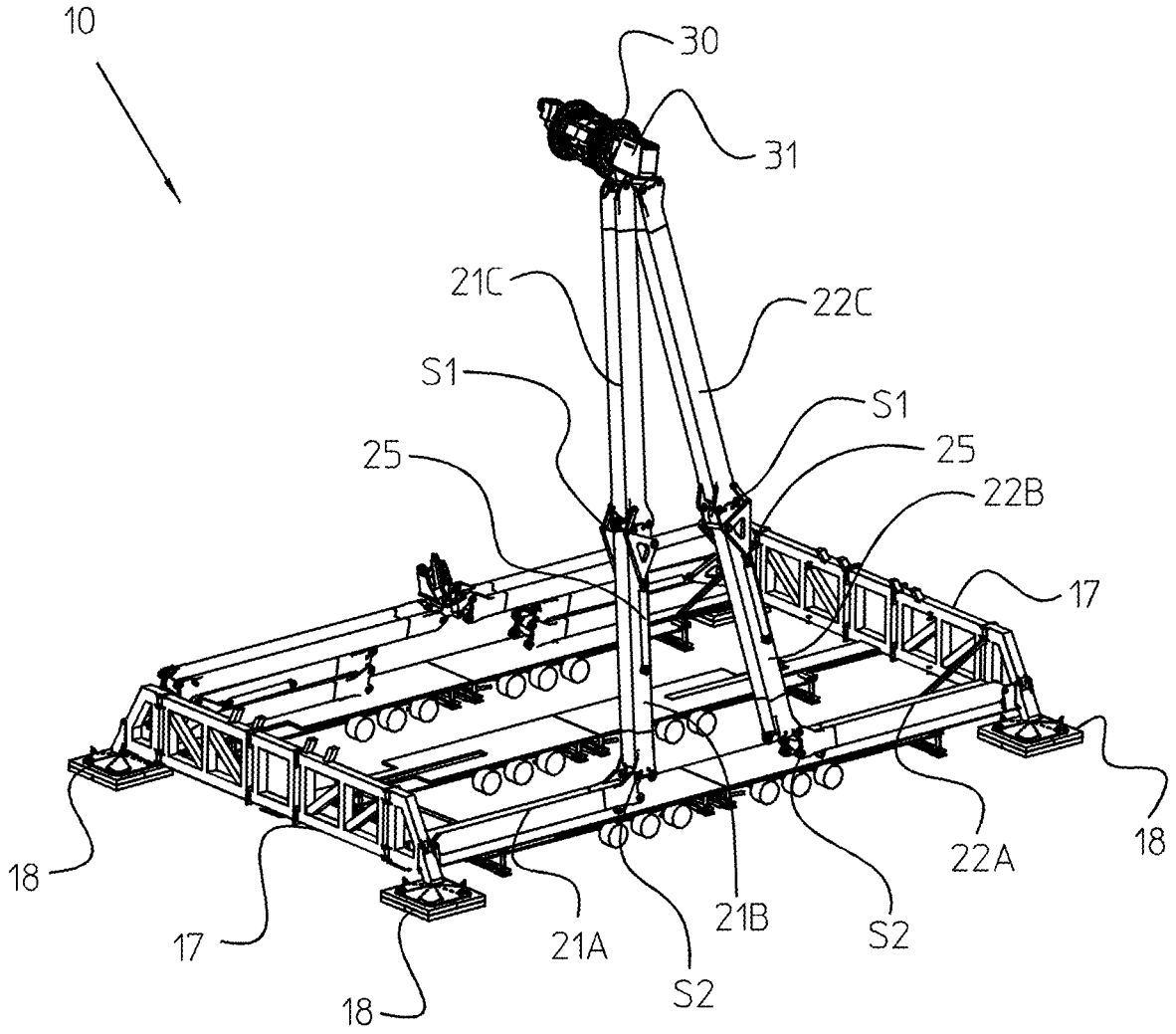
Figure 5D:
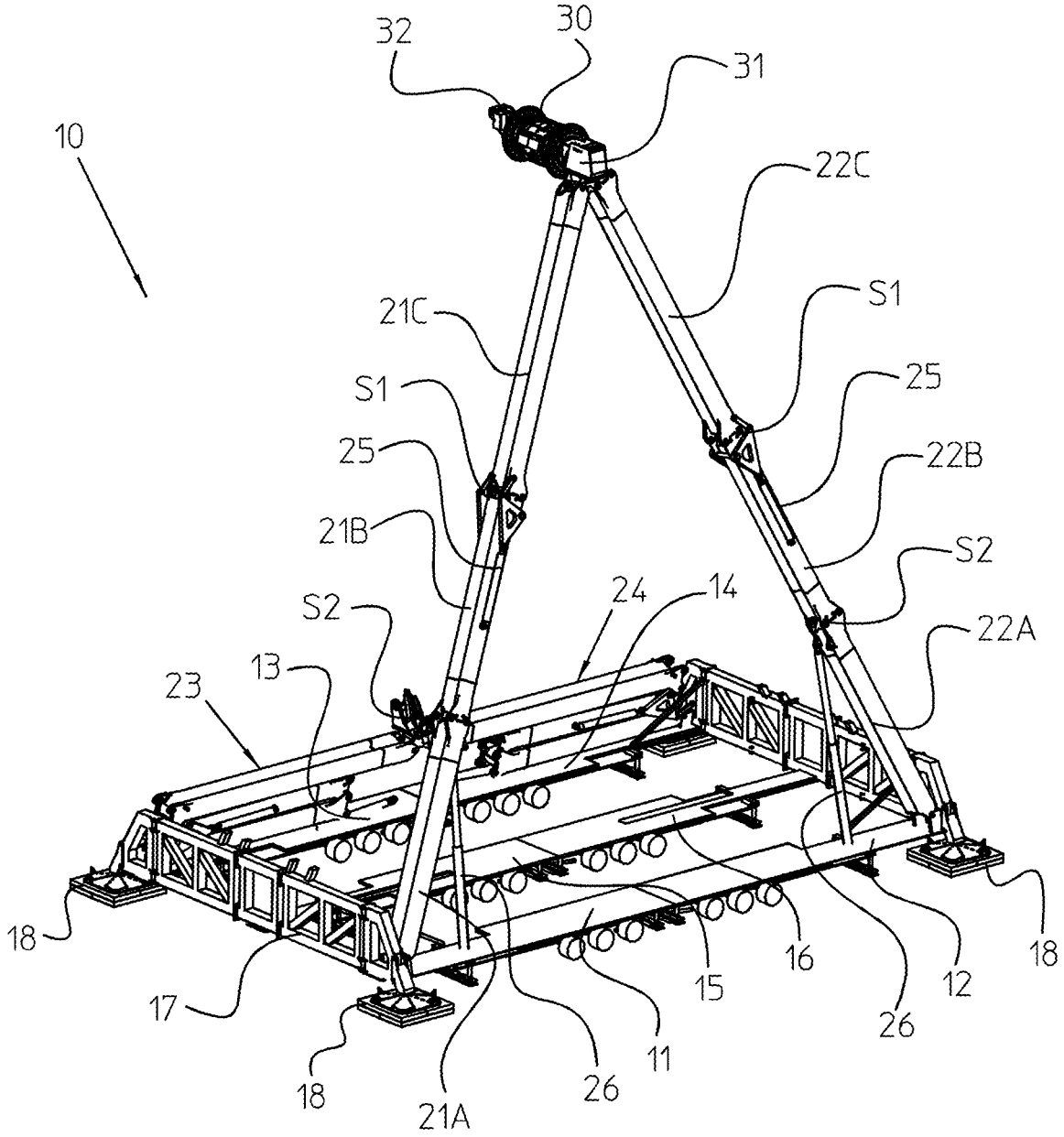
Figure 5E:
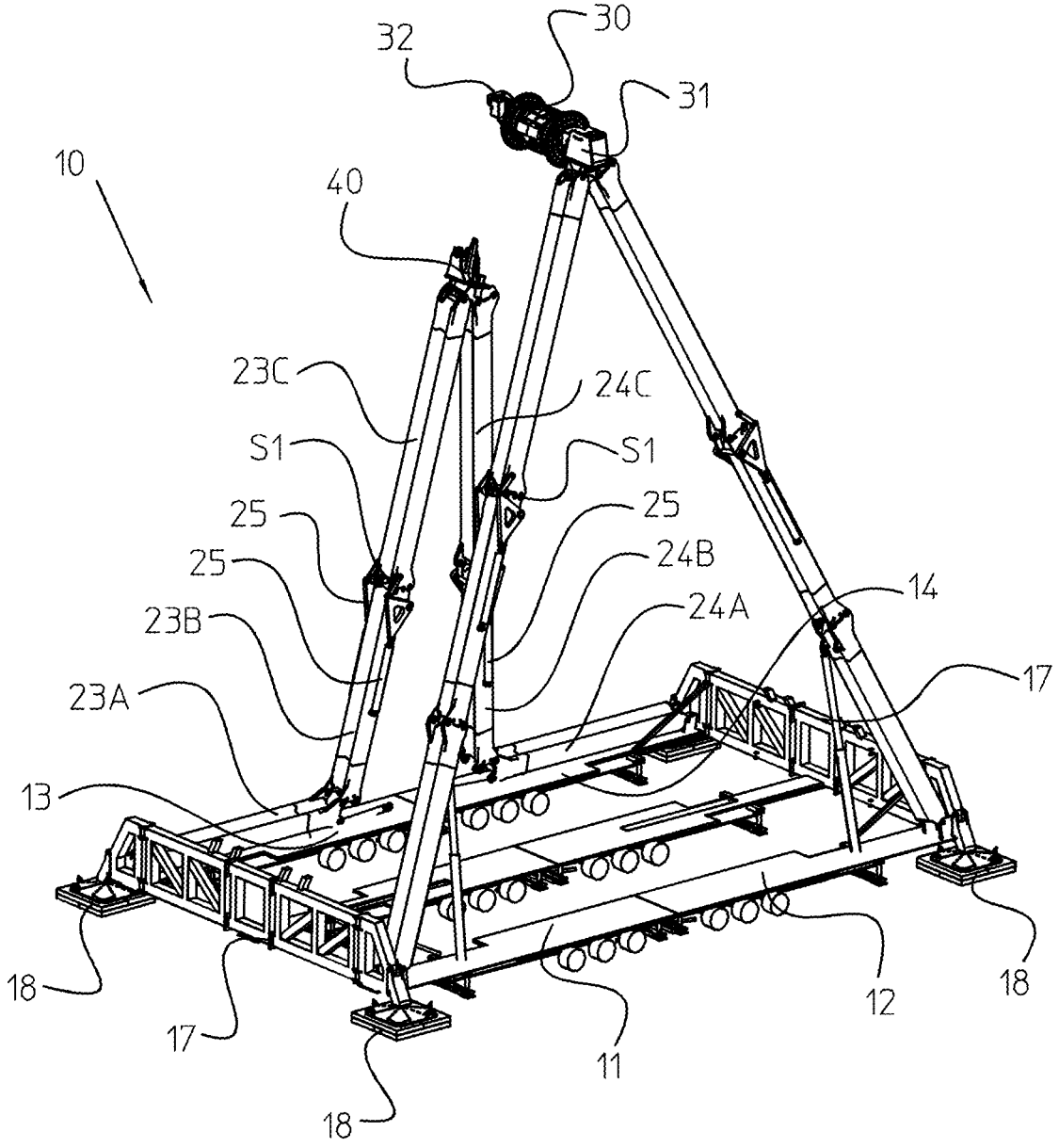
Figure 5F:
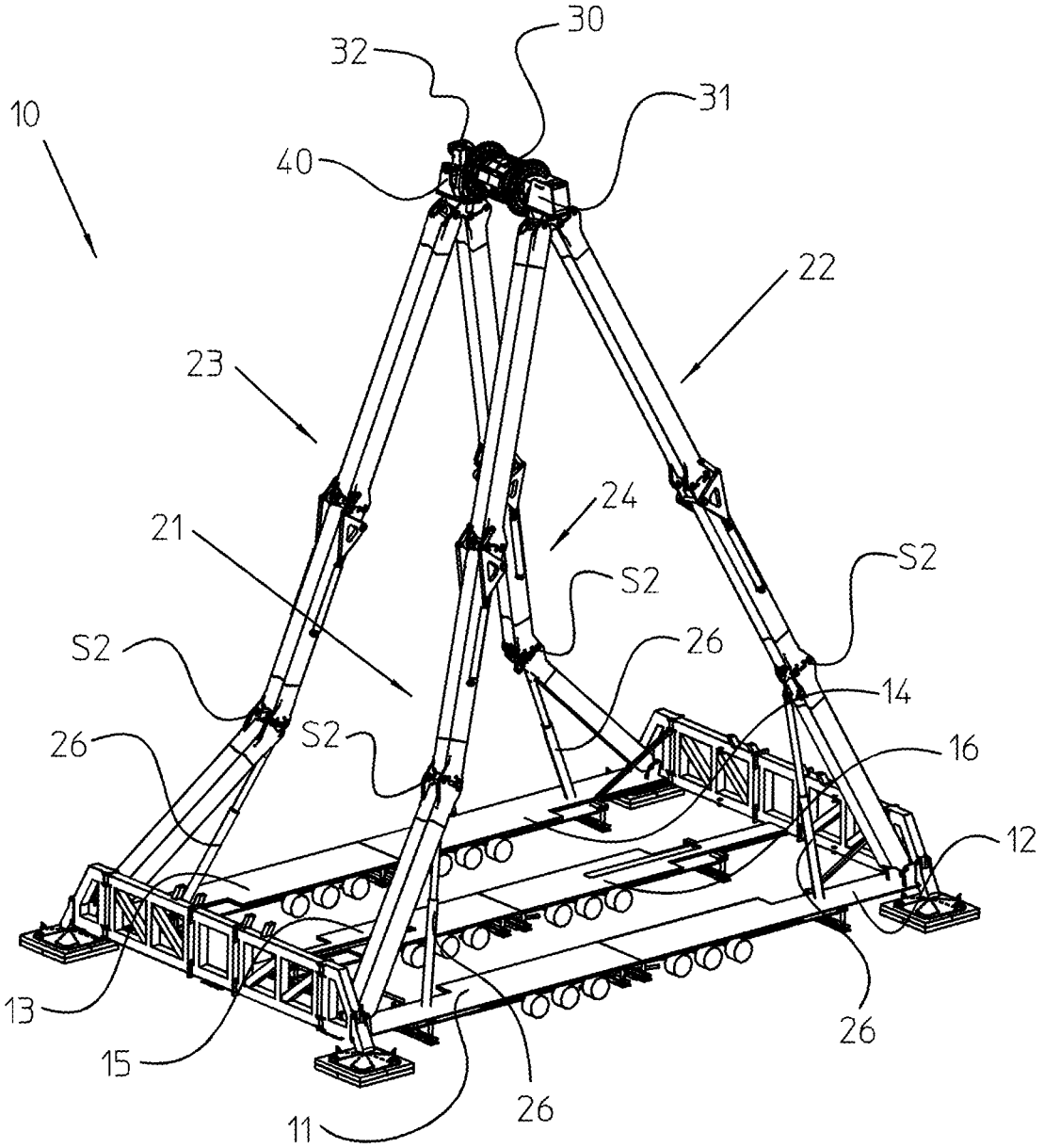
Figure 5G:
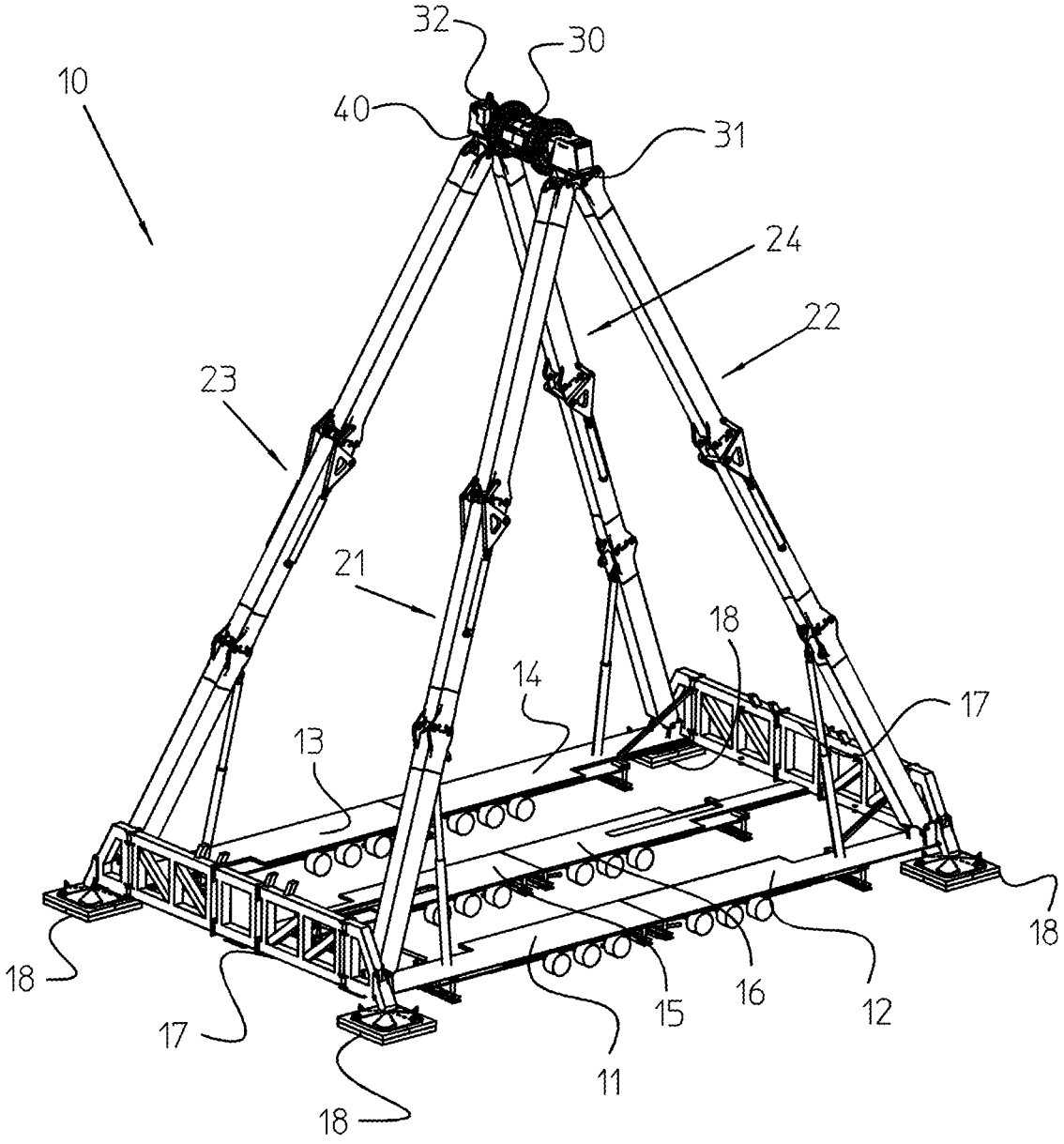

FIG. 3 schematically shows a detail of the support construction according to the invention from FIG. 1;

FIG. 4 schematically shows another detail of the support construction according to the invention from FIG. 1;

FIG. 5A shows a schematic view of a first preferred embodiment of the support construction according to the invention with masts in a folded position;

FIG. 5B up until 5F schematically illustrate the movement of the masts between the folded position and a stretched position; and FIG. 5G shows a schematic view of the first preferred embodiment of the support construction according to the invention from FIG. 5A with the masts in stretched position.

Figure 2:
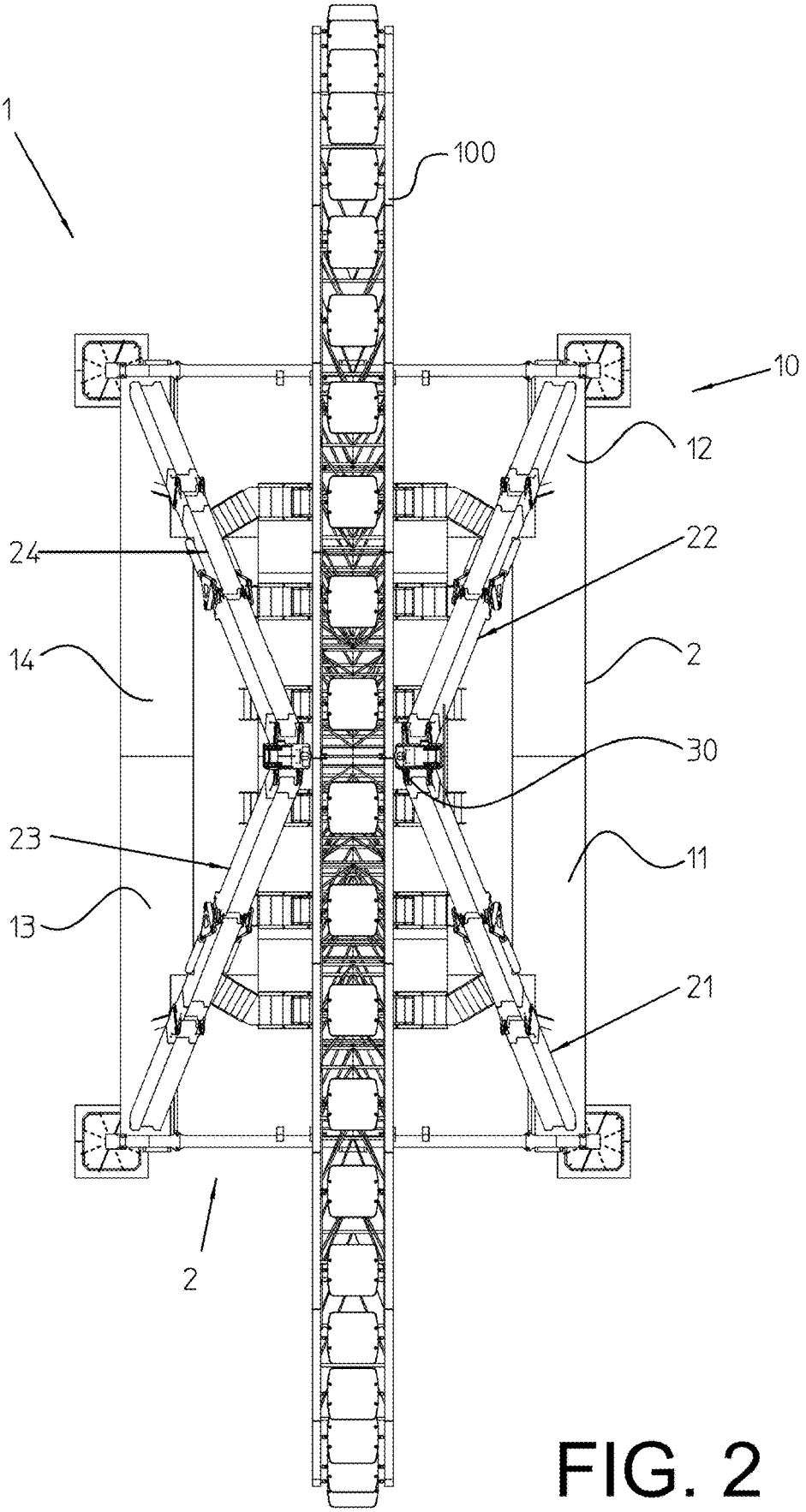
FIG. 2 shows the attraction from FIG. 1 in a schematic top view.

FIG. 1 shows a schematic view of an attraction 1 with a support construction 10 according to the invention in a position of use. FIG. 2 shows the attraction 1 in a schematic top view.

The support construction 10 is intended for a mobile attraction for amusement rides, such as a fairground attraction. In the shown preferred embodiment, attraction 1 comprises a Ferris wheel 100, which is mounted rotatably on the support construction 10.

The support construction 10 is provided with a base 2, which comprises at least four trailers 11, 12, 13, 14 in the shown preferred embodiment. The support construction 10 further comprises four masts 21, 22, 23, 24, which are each moveable between a folded position (shown in FIG. 5A) and a stretched position (shown in FIG. 5G). On each trailer a mast is located, such that each trailer can transport a mast in the folded position.

A main shaft 30 is intended to be supported by the masts 21, 22, 23, 24 in the stretched position of the masts. On the main shaft 30 a rotatable part of the attraction 1, here a Ferris wheel 100, can be mounted.

The Ferris wheel 100 is made up of a number of spokes 101, which extend radially from the main shaft 30. The spokes 101 are interconnected at their ends by ring segments 102, which together form an outer ring of the Ferris wheel 100 on which gondolas 106 are suspended. The spokes 101 are connected at several positions along their length by further ring segments 103, 104 and 105, that form further inner rings. Preferably, both the spokes 101 and the ring segments 102, 103, 104, 105 are arranged with double legs. The main shaft 30 is provided with bearing wheels 33 with openings 38 (shown in FIG. 3) for receiving the legs of the spokes 101.

For the transport of the parts of the attraction, in this example the spokes 101 and the ring segments 102, 103, 104, 105, further trailers 15, 16 are provided.

Each mast 21, 22, 23, 24 comprises a base mast segment 21A, 22A, 23A, 24A, which is hingedly attachable to the respective trailer 11, 12, 13, 14. Each mast 21, 22, 23, 24 also comprises a top mast segment 21C, 22C, 23C, 24C, which is hingedly connected to the base mast segment 21A, 22A, 23A, 24A and is couplable with the main shaft 30.

In the shown preferred embodiment of the support construction 10, each mast comprises a middle mast segment 21B, 22B, 23B, 24B, which is on the one hand hingedly connected with the base mast segment 21A, 22A, 23A, 24A, and is on the other hand hingedly connected with the top mast segment 21C, 22C, 23C, 24C.

Each trailer 11, 12, 13, 14 has a longitudinal direction and the mast segments of the mast 21, 22, 23, 24 attached to the trailer extend tilted relative to this longitudinal direction.

FIGS. 3 and 4 schematically show further details of the support construction 10, especially of the main shaft 30 and of the first and second mast coupling means 31, 40. Herein the first mast coupling means 31 are shown for the pairwise coupling of the masts 21, 22 and the second mast coupling means 40 for the pairwise coupling of the masts 23, 24. The main shaft 30 extends in mounted condition between the first and the second mast coupling means 31, 40. In the shown preferred embodiment the main shaft 30 is connected with the first mast coupling means 31 and with the connecting means 32 for releasable attachment on the second mast coupling means 40.

The first mast coupling means 31 comprise coupling plates 34 with coupling openings 35. The top mast segments 21C and 22C are provided with corresponding coupling openings 28. Coupling pins 27 extend through the coupling openings 28, 35.

The connecting means 32 are provided with a search hole 36 and with locking openings 37.

The second mast coupling means 40 comprise coupling plates 44 with coupling openings 45. The top mast segments 23C and 24C are provided with corresponding coupling openings 28. Coupling pins 27 extend through the coupling openings 28, 45.

The second mast coupling means 40 are further provided with one or more search elements, arranged for accommodation in corresponding search holes on the connecting means 32. A search element 41 is shown to be received in the search hole 36. A further search element 42 is shown for accommodation in a further search hole (not shown). The second mast coupling means 40 are further provided with locking openings 43 that correspond with the locking holes 37 and are used for the receival of locking pins (not shown).

The raising of the masts is illustrated in FIG. 5A up until 5G, wherein, aside from the folded position and the stretched position, there are also shown various intermediate positions of the masts 21, 22, 23, 24.

FIG. 5A shows a schematic view of the first preferred embodiment of the support construction 10 with masts 21, 22, 23, 24 in a folded position. The trailers 11 and 12 are intercoupled on the short sides with the help of suitable trailer coupling means (not shown). The top mast segments 21C and 22C are coupled by the first mast coupling means 31, to which the main shaft 30 is connected. The trailers 13, 14 are intercoupled on the short sides with the help of suitable trailer coupling means (not shown). The top mast segments 23C and 24C are coupled by the second mast coupling means 40. The free short sides of the trailers 11 and 13 are coupled by a fence 17, which is supported by stamps 18. The free short sides of the trailers 12 and 14 are coupled as well by a fence 17 which is supported by stamps 18. The coupled trailers 11, 12, 13, 14 form a steady base for the attraction 1. The masts 21, 22, 23, 24 can be raised from the shown folded position or transport position to the stretched position or position of use.

FIG. 5B shows a schematic view of the first preferred embodiment of the support construction 10 with masts 21, 22 in a first intermediate position. Mast segments 21C and 21B move together with the mast segments 22C and 22B to the partly stretched position shown in FIG. 5C. In the shown preferred embodiment, the top mast segment 21C, 22C is at each mast 21, 22 connected with the middle mast segment 21B, 22B by a first power hinge S1 that is operatable by first operating means 25, preferably hydraulic cylinders. In the shown first intermediate position, the mast segments 21C and 21B are at an angle between 0 and 90 degrees and the mast segments 22C and 22B are at an angle between 0 and 90 degrees. Both angles are substantially equal.

FIG. 5D shows a schematic view of the first preferred embodiment of the support construction 10 with masts 21, 22 in the completely stretched position. In the shown preferred embodiment, at each mast 21, 22 the base mast segment 21A, 22A is connected with the middle mast segment 21B, 22B by a second hinge S2, which closes and opens by operation of the second operating means 26, preferably hydraulic cylinders, which extend between the base mast segment 21A, 22A and the respective trailer 11, 12.

In a similar way as described for the masts 21, 22, masts 23, 25 move to the first intermediate position, which is shown in FIG. 5E. Mast segments 23C and 23B move together with mast segments 24C and 24B to the partly stretched position shown in FIG. 5E. In the shown preferred embodiment, at each mast 23, 24 the top segment 23C, 24C is connected with the middle mast segment 23B, 24B by a first power hinge S1, which is operatable by first operating means 25, preferably hydraulic cylinders.

FIG. 5G shows a schematic view of the first preferred embodiment of the support construction 10 with masts 21, 22, 23, 24 in the completely stretched position. In the shown preferred embodiment, at each mast 23, 24 the base mast segment 23A, 24A is connected with the middle mast segment 23B, 24B by a second hinge S2, which closes and opens by operation of second operating means 26, preferably hydraulic cylinders, which extend between the base mast segment 23A, 24A and the respective trailer 13, 14.

In the completely stretched position of the masts 21, 22, 23, 24, the main shaft 30 can be mounted. In the shown preferred embodiment this takes place by connecting the main shaft 30 with the second coupling means 40. The aligning of the main shaft 30 relative to the mast coupling means 40 happens by operating the second operating means 26. This alignment is illustrated in FIG. 5F, wherein a number of the second hinges S2 are shown in a kinked position. Because the masts are pivotable out of the plane that extends perpendicular onto the trailers, the main shaft 30 and the mast coupling means 40 move towards each other when the second hinges S2 close and move away from each other when the second hinges S2 open.

In the stretched position, the first and second coupling means secure the hinges S1, S2 in the closed position. For safety, there are additional locking means provided for the locking of the hinges. An example of suitable locking means is blocking pins. Preferably the blocking pins are remotely controllable and secured by position detection means.

The hinges S1 and S2 act in opposite direction, such that the mast segments are laying on top of each other in the folded position. The length of the mast segments is preferably maximally equal to the longest measurements of the trailer. In Europe, the length of a standard trailer is 13.60 meter and the width is 2.55 meter.

In the shown preferred embodiment of the masts, the length of the top mast segment is longer than the length of the middle mast segment and longer than the length of the base mast segment and the length of the base mast segment is substantially equal to the length of the middle mast segment. With masts of this length, the support construction can support a Ferris wheel with a height of 60 to 70 meters.

The inventive thought is based on the insight that the support construction comprises a number of trailers, which can each transport one mast in the folded position, and that the base is formed on site by coupling the trailers and by coupling the masts. Preferably, the main shaft is laying during transport on one of the trailers with the length orientated parallel to the longitudinal direction of the trailer. On site the main shaft can be positioned in the right orientation to be coupled with the first and second mast with the help of a truck-mounted crane of a tow vehicle. The masts of the support construction according to the invention can independently move between the folded and stretched position.

The number of trailers of the support construction depends on the kind of attraction that will be attached to it and is at least two. Even for a Ferris wheel, a support construction of two masts can suffice.

A Ferris wheel is but an example. Instead, one can also opt for a different type of attraction, for example a swing, which can be rotatably mounted about the main shaft.

In general it applies that suitable hinges, operating means and locking means, as well as trailer coupling means are known in the relevant technical field.

The invention is therefore not limited to the described and shown preferred embodiment but extends to any embodiment falling within the scope of the scope of protection, such as defined in the claims and seen in the light of the foregoing description and associated figures.

The invention claimed is:

1. A support construction for a transportable attraction for amusement rides, provided with a base, at least two masts that are moveable between a folded and stretched position, and a main shaft that is intended to be supported by the masts in the stretched position of the masts, wherein a rotatable part of the attraction can be mounted on the main shaft, wherein each mast comprises a base mast segment, which is hingedly attached to the base, and a top mast segment, which is hingedly connected with the base mast segment and is attachable to the main shaft, wherein the base comprises at least two trailers and trailer coupling means for coupling the trailers, wherein on each of the trailers a base mast segment of one of the masts is mounted, characterized in that, the support construction further comprises first mast coupling means for the coupling of the at least two masts as a first pair of masts in folded position, when the at least two trailers are coupled.

2. The support construction according to claim 1, wherein the support construction comprises four masts and the base comprises four trailers, wherein on each of the four trailers a base mast segment of one of the four masts is mounted, wherein the support construction further comprises second mast coupling means for the coupling of a third one of the four masts and a fourth one of the four masts as a second pair of masts in folded position.

3. The support construction according to claim 2, wherein the main shaft is at the opposite end provided with connecting means for a connection with the second mast coupling means.

4. The support construction according to claim 1, wherein the main shaft is at one end provided with the first mast coupling means.

5. The support construction according to claim 1, wherein each mast comprises a middle mast segment, which is hingedly connected to the base mast segment and the top mast segment.

6. The support construction according to claim 5, wherein the middle mast segment and the top mast segment are connected by a first power hinge and the middle mast segment is provided with first operating means for operating the first power hinge.

7. The support construction according to claim 5, wherein the middle mast segment and the base mast segment are connected by a second hinge, which closes and opens by operating second operating means, which extend from the respective trailer to the base mast segment.

8. The support construction according to claim 1, wherein each trailer has a longitudinal direction and the mast segments of the mast attached to the trailer extend pivotably from the plane that extends perpendicularly on the trailer in the longitudinal direction.

9. A method for raising a support construction for a transportable attraction for amusement rides, provided with a base, at least four masts that are moveable between a folded and stretched position, and a main shaft that is intended to be supported by the masts in the stretched position of the masts, wherein a rotatable part of the attraction can be mounted on the main shaft, wherein each mast comprises a base mast segment, which is hingedly attached to the base, and a top mast segment, which is hingedly connected with the base mast segment and is attachable to the main shaft, wherein the base comprises at least four trailers and trailer coupling means for coupling the trailers, wherein on each of the trailers a base mast segment of one of the masts is mounted, wherein the support construction further comprises first mast coupling means for the coupling of a first pair of masts in folded position, wherein the support construction further comprises second mast coupling means for the coupling of a second pair of masts in folded position, wherein the method comprises the following steps:

a) the pairwise positioning of the trailers with adjacent short sides;
b) the coupling of the trailers with the trailer coupling means;
c) the pairwise coupling of the first and second mast in folded position with the first mast coupling means and the main shaft;
d) the pairwise coupling of the third and fourth mast in folded position with the second mast coupling means;
e) the joint raising of the first and second mast;
f) the joint raising of the third and fourth mast; and
g) the connecting of the main shaft with the second mast coupling means.

10. The method of claim 9, further comprising the step of alignment of the main shaft relative to the second mast coupling means by the hinging of one or more of the base mast segments.

* * * * *